US005560186A

United States Patent [19]

Raudat

[11] Patent Number: 5,560,186

[45] Date of Patent: Oct. 1, 1996

[54] HOT PLASTIC BOTTLE PACKER

[75] Inventor: John L. Raudat, Madison, Conn.

[73] Assignee: Standard-Knapp, Inc., Portland, Conn.

[21] Appl. No.: 552,705

[22] Filed: Nov. 3, 1995

[51] Int. Cl.[6] ..... B65B 5/08; B65B 35/30; B65B 21/10

[52] U.S. Cl. ..... 53/534; 53/244; 53/251

[58] Field of Search ..... 53/534, 543, 244, 53/246, 251, 250, 249, 248, 531, 448, 443

[56] References Cited

U.S. PATENT DOCUMENTS

| | | | |
|---|---|---|---|
| 4,531,345 | 7/1985 | Nigrelli et al. | 53/534 |
| 4,541,524 | 9/1985 | McGill et al. | 53/534 X |
| 4,949,531 | 8/1990 | Langenbeck et al. | 53/534 |
| 5,197,261 | 3/1993 | Hartness et al. | 53/534 |
| 5,212,930 | 5/1993 | Raudat | 53/534 X |
| 5,241,805 | 9/1993 | Johnson | 53/534 |

*Primary Examiner*—James F. Coan
*Attorney, Agent, or Firm*—McCormick, Paulding & Huber

[57] ABSTRACT

Plastic bottles filled with hot liquid such as fruit juices or the like are packaged in cases fed in line below the path of these bottles in the machine. Line pressure urges the bottles down an inclined ramp into a load station where the plastic trays are continuously filled with the bottles. The trays are indexed by a flight bar conveyor that lifts each tray turn at the load station. Overhead flight bar conveyor chains operate separator pegs that move downwardly between selected article rows to index groups of the softened hot bottles as they are loaded into the inline trays. Overhead separator discs are used in place of these flight bars and pegs for loading conventional plastic bottles or the like.

7 Claims, 5 Drawing Sheets

HOT PLASTIC BOTTLE PACKER

CROSS REFERENCE TO RELATED PATENTS

This application is an improvement to that disclosed in U.S. Pat. No. 5,241,805 issued to Johnson and assigned to the assignee herein. The disclosure in U.S. Pat. No. 5,241,805 is incorporated by reference herein.

BACKGROUND OF THE INVENTION

1. Field of the Invention

This invention relates generally to packers for loading articles such as plastic bottles into upwardly open cases or trays that are adapted to receive two or more side-by-side columns of such bottles in aligned rows. Line pressure from a conveyor moves the bottles across a ramp into a load station. Support for the bottles at the load station is preferably provided by side guides which engage shoulders on the bottles. The trays or cases move upwardly from below the path of the columns of bottles into the load station as disclosed in said U.S. Pat. No. 5,241,805. As disclosed therein, each tray is elevated slightly at its rear or aft end by a flight bar conveyor system that is used to synchronized the trays with movement of the bottles. In the present invention, an overhead flight bar lug conveyor system is also provided for inserting separator pegs between certain article rows to correspond to the gap required for filling the inline cases or trays. The side guides engage shoulders in the plastic bottles rather than neck ring guides for engaging the necks of the bottles as disclosed in U.S. Pat. No. 5,241,805.

(2) Description of the Prior Art

U.S. Pat. No. 5,241,805 shows a system for loading plastic bottles into in line cases or trays wherein the articles are guided by neck ring guides and wherein rotating disks provided with projecting circumferentially spaced lugs move downwardly between the articles and more particularly between those articles which must be separated to accommodate the end panels of the in line cases. The prior art system disclosed in U.S. Pat. No. 5,241,805 suffers from the disadvantage that relatively soft plastic bottles which have been recently filled with a relatively hot liquid, such as fruit juice or the like, cannot be conveniently accommodated by these rotating disks to create the desired spacing between the article rows for accommodating the panels of the in line cases.

The general purpose of the present invention is to provide a packer capable of handling two or more columns of relatively soft plastic bottles and depositing these bottles into upwardly open in-line or end-to-end cases or trays. The bottles are relatively flexible as a result of the plastic bottle being heated by the hot liquid contained therein. Preferably, the bottles have shoulders defined between the neck and the bottom of the bottles which shoulders are engaged by side guides to support the articles as they are fed into the load station. Further, a lug conveyor system is provided for positively creating the desired gap between adjacent rows to accommodate the panels of the adjacent inline cases or trays.

SUMMARY OF THE INVENTION

In accordance with the present invention, a bottle packer is disclosed for handling two or more columns of hot plastic bottles, and continuously depositing these bottles into upperwardly open end to end cases while the bottles and the cases move continuously in a downstream direction through the machine.

As in the prior U.S. Pat. No. 5,241,805, a load station is provided to receive the cases conveyed to the load station by conveyor means including a flight bar conveyor system where the flight bars are spaced from one another slightly less than the length of each case or tray to be handled at the load station. Such a flight bar spacing affords a convenient means for timing and positioning the cases or trays so that they can be synchronized with movement of the bottles to be packed all as described in the said prior U.S. Pat. No. 5,241,805.

A bottle conveyor advances the articles by line pressure down an inclined path toward the load station where groups of the articles are mated with an associated case or tray as in the prior U.S. Pat. No. 5,241,805.

In accordance with the present invention, means is provided at the load station to provide control of the articles coming into and actually being loaded into a case moving through the load station. Such means preferably takes the form of a lug conveyor system that provides depending lugs or pegs which move downwardly into and between the bottles to create a gap between those rows of articles which will be dropped into the aft end of one case and into the forward end of the succeeding case. The lug conveyor system for accomplishing this task can be conveniently provided as a replacement assembly for the rotating series of disks or wheels that are arranged on a common shaft and which are designed to handle more conventional plastic bottles all as disclosed in prior U.S. Pat. No. 5,241,805. The present invention affords a convenient changeover system for effecting changeover of a packer from handling the conventional plastic bottles to a packer for handling relatively hot plastic bottles of the type having an indented shoulder provided between the neck and the bottom of each bottle.

DETAILED DESCRIPTION OF FIG. 1

Figure 1:
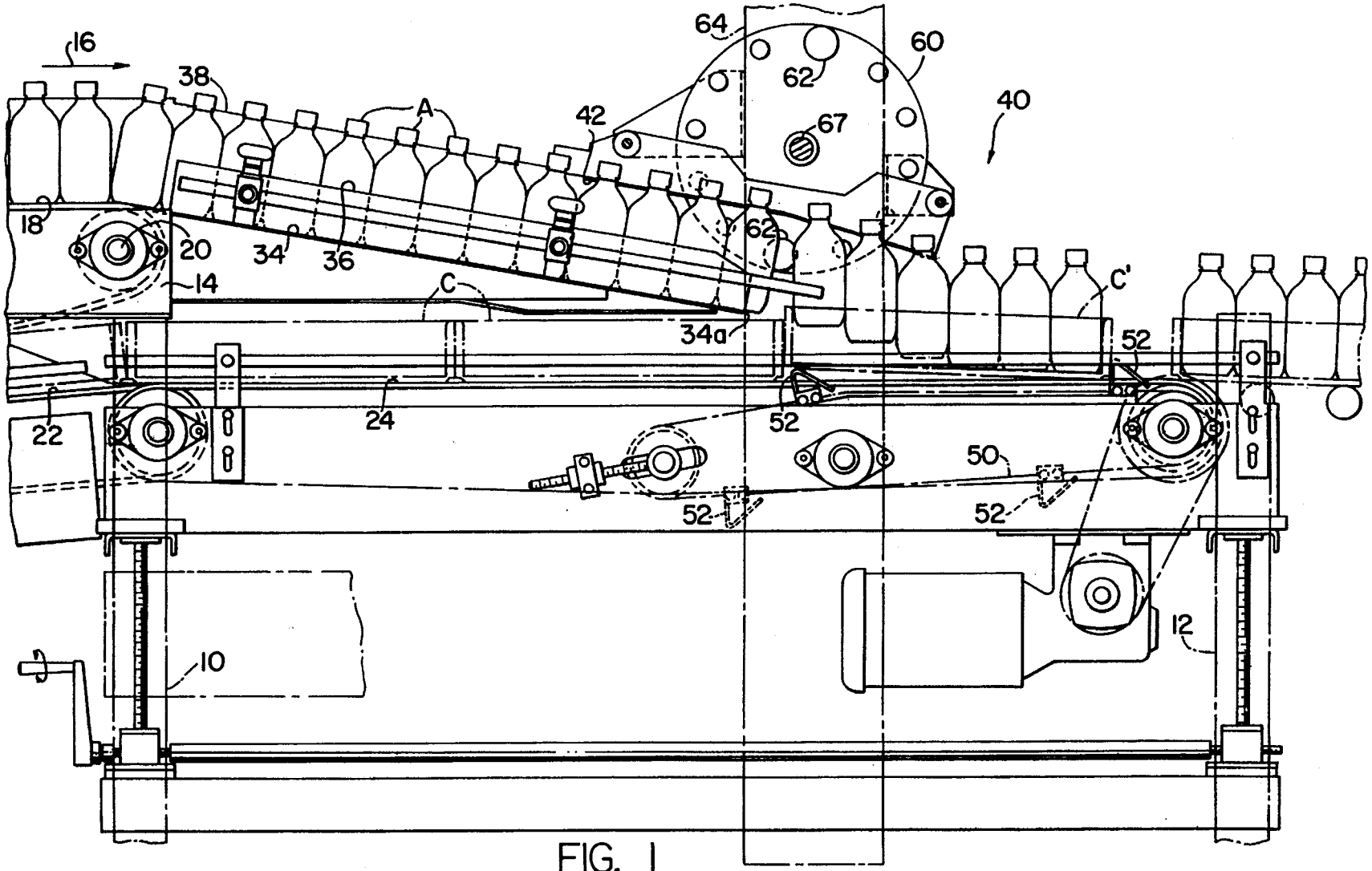
FIG. 1 PRIOR ART
FIG. 1 is a side elevational view with portions broken away or omitted illustrating a packer in accordance with the above-mentioned U.S. Pat. No. 5,241,805 which patent is incorporated by reference herein.

FIG. 1 is taken directly from the assignee's prior U.S. Pat. No. 5,241,805, and shows a packer that includes a fixed frame having legs 10 and 12 for supporting the frame. The frame further includes a conveyor support structure, indicated generally at 14, and a conveyor 18 for moving articles such as plastic bottles in parallel side-by-side columns in the general direction of the arrow 16. The article conveyor 18 is driven from the head shaft, indicated generally at 20 by a drive motor (not shown).

Plastic trays or cases to be loaded are fed below the path of the plastic bottles on a case conveyor 22 which provides cases c,c in end-to-end relationship for further handling by a pair of spaced apart conveyors, one of which is shown at 24.

The side-by-side lanes or columns of bottles are moved by line pressure from article conveyor 18 onto an inclined deadplate or ramp, which is indicated generally at 34 in FIG. 1. Side guides 36,36 are provided at the sides of the bottles as they move down the inclined ramp 34, and lane dividers 38 are also provided for further supporting and guiding the bottles in the side-by-side columns for movement down the ramp toward a load station which is indicated generally at 40.

The ramp 34 has a downstream edge 34*a* which is provided just short of the load station 40 so that the bottles must be further guided into the load station. Inclined neck ring guides indicated generally at 42 in FIG. 1 represent one means for guiding these plastic bottles into the load station. Prior U.S. Pat. No. 5,241,805 shows the neck ring guides defining slots that slidably receive the plastic bottles and support these bottles from their upper ends as they are further acted upon by rotating separator disks 60,60.

Still with reference to U.S. Pat. No. 5,241,805, the cases c,c are fed upwardly toward the load station by laterally spaced, vertically adjustable case conveyors 24,24. Case indexing means in the form of a flight bar conveyor 50 controls the cases moving into the load station 40 and each flight bar moves upwardly at the load station between the laterally spaced case conveyors 24,24 to lift each case as shown in FIG. 1. These flight bars 52 are spaced apart a distance slightly less than the length of the cases being handled so that each flight bar moves upwardly through the plane defined by the spaced case conveyors 24 so as to lift the trailing end of each case in turn as that case moves through the load station 40. This lifting action not only serves to assist in the loading of the articles, but also serves to control the cases behind each flight bar so as to permit timing of the case movement with movement of the articles or bottles being loaded. In the prior U.S. Pat. No. 5,241,805, the bottles are controlled in their movement so as to correlate with movement of the underlying case with the rotating separator disks 60,60 provided in a superstructure 64. These disks are provided on a common shaft 67 and driven by a drive motor (not shown). Each disk 60 has at least one projecting plug or lug provided adjacent its periphery as indicated generally at 62 and preferably two such lugs 62,62 are provided on each disk 60. The geometry of the disk is such that the radius of the disk corresponds roughly to the height of the bottles to be loaded, and so that the circumference of the disk is related to the length of the cases to be loaded. More particularly, with respect to the two larger lugs, 62,62 on each disk 60, the circumference of the disk is roughly twice the length of the case c.

While the above-described packer has been found quite satisfactory in the loading of plastic bottles which can be supported from their neck rings by neck ring guides all as described above, the handling of relatively hot plastic bottles of the type commonly filled with hot fruit juice or the like cannot be so handled as the plastic is too soft and flexible for handling in the manner described above.

DETAILED DESCRIPTION OF FIGS. 2 AND 3

Figures 2, 2A, 2B:
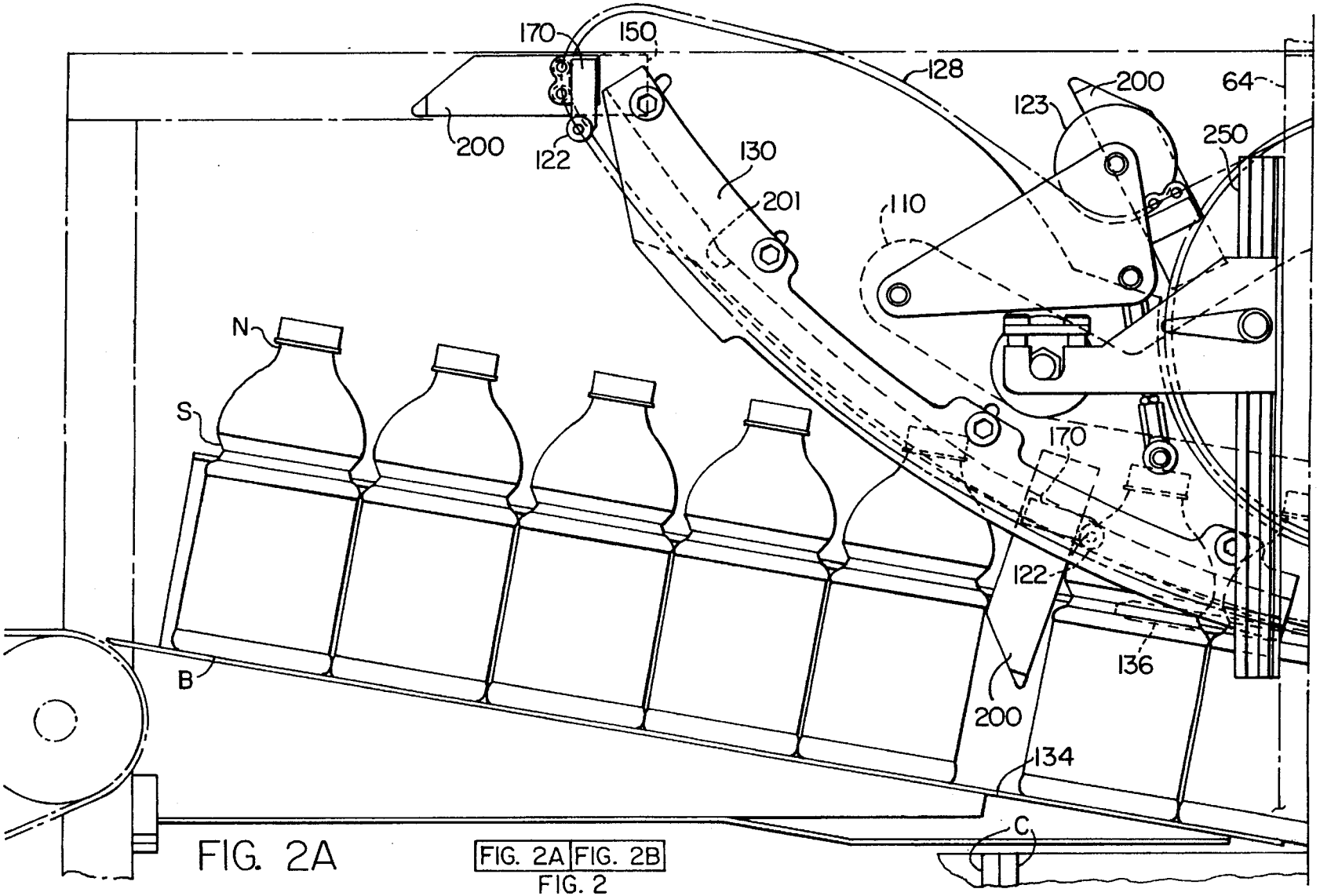
FIG. 2 is a side elevational view illustrating portions of the packer of FIG. 1, but with the rotating separator disks removed and replaced with a replacement assembly of the present invention, including conveyor lugs or pegs adapted to move downwardly between the bottles to create the desired gaps between adjacent rows, side guide means for engaging the shoulders of the hot plastic bottles being handled.
Figure 3A:
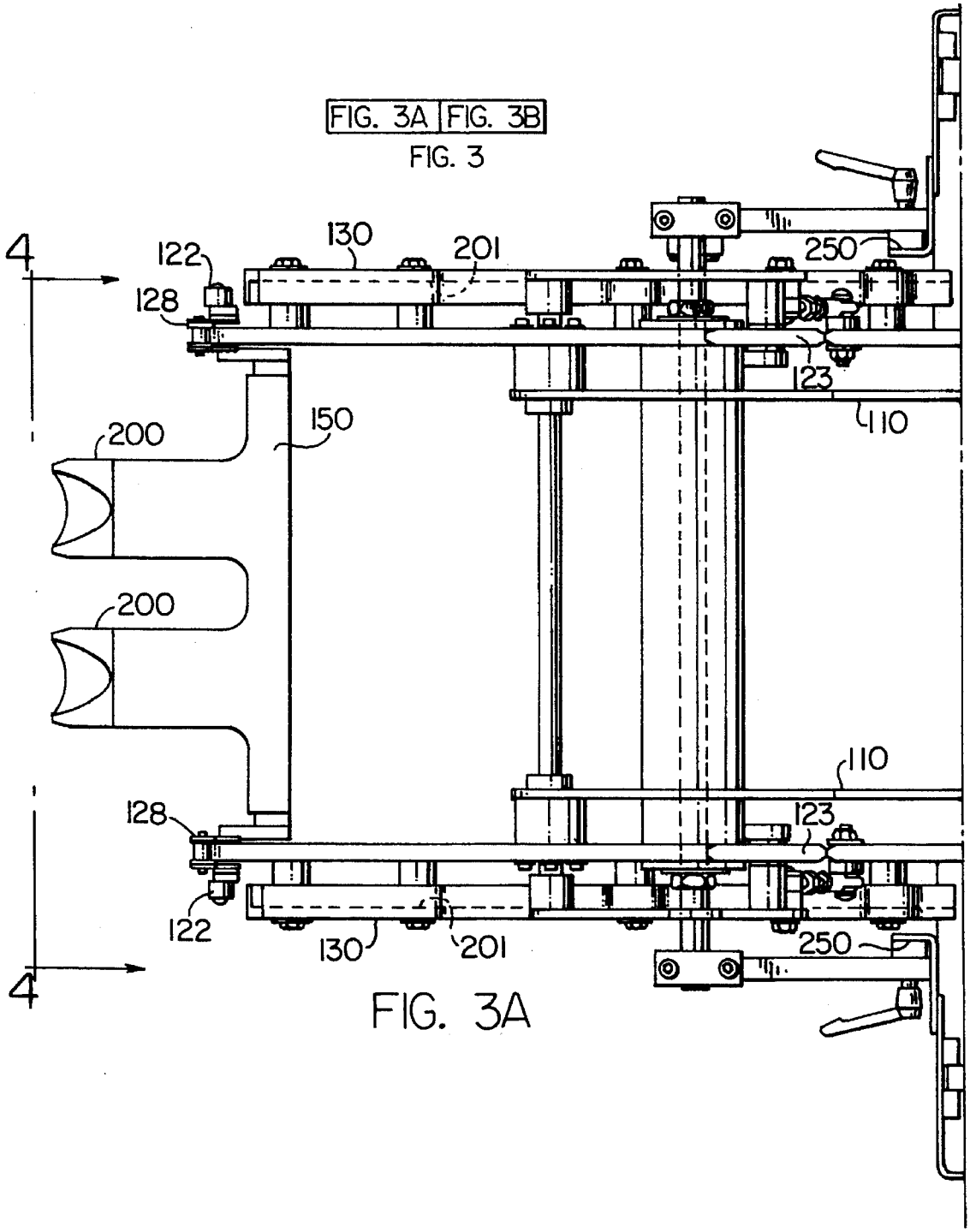
FIG. 3 is a top plan view of the replacement assembly depicted in FIG. 2.
Figure 3B:
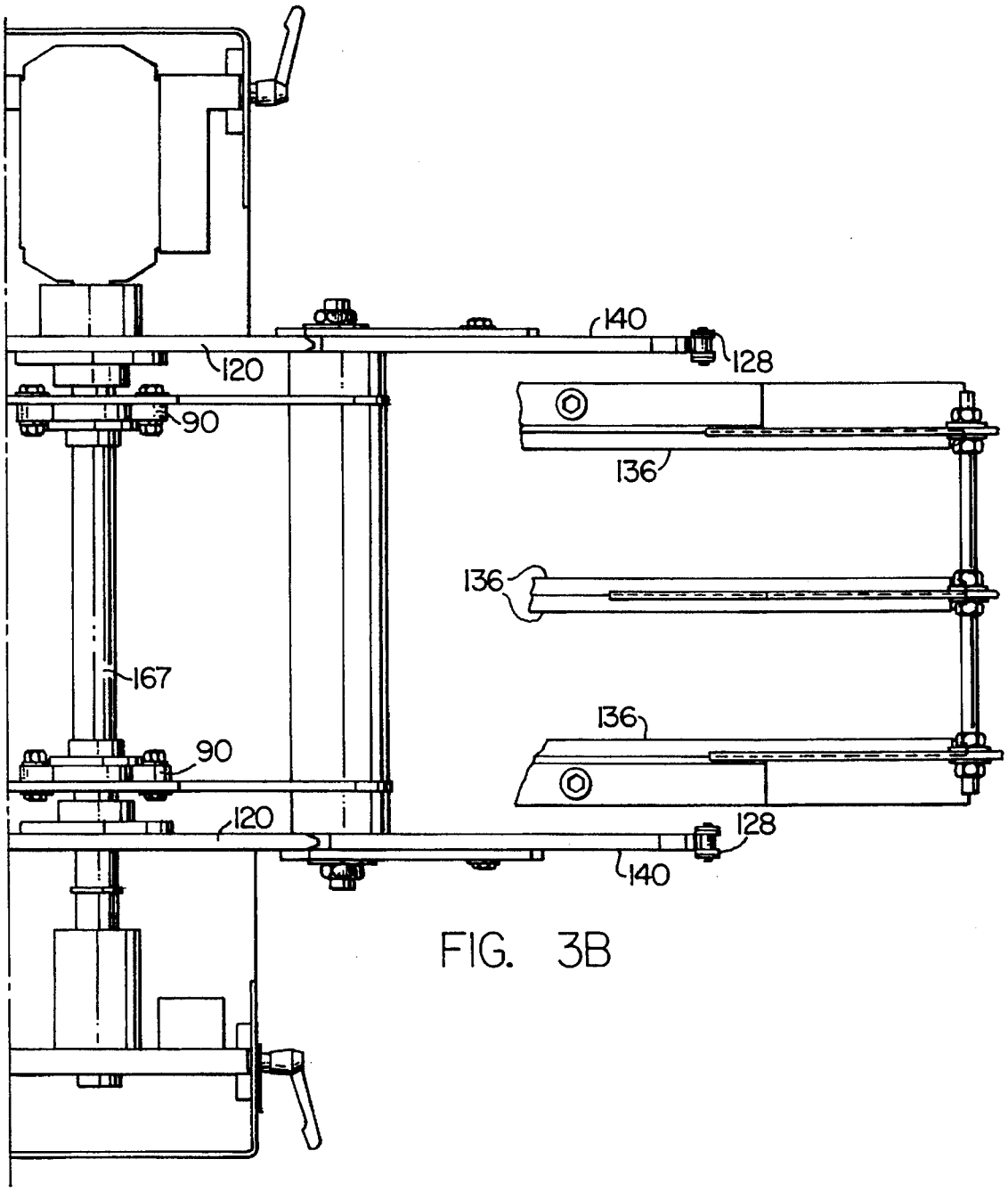

Turning next to a detailed description of FIGS. 2 and 3 of the drawings, the improvement of the present invention is there shown as a replacement assembly for the rotating separator disks disclosed in prior U.S. Pat. No. 5,241,805.

Turning first to a brief description of the plastic bottles themselves, FIG. 2 shows that the bottles to be handled are of somewhat different shape than those in FIG. 1 from U.S. Pat. No. 5,241,805. The bottles of FIG. 2 have indented shoulders S provided between the neck N portion and the bottom B of each of the bottles. Advantage is taken of this indented configuration of the bottle shoulder S by providing side guides, which function in much the same way as the neck ring guides disclosed in U.S. Pat. No. 5,241,805. These side guides are indicated generally at 136 in FIGS. 2 and 3, the full extent of the side guide being shown in FIG. 2. FIG. 3 illustrates in plan view portions of three side guides required for handling two columns of bottles.

The lug or peg conveyor system of the present invention creates gaps between certain of the adjacent rows of plastic bottles being fed by line pressure down the ramp 134 of FIG. 2. The present invention utilizes the same drive system for this novel lug conveyor as formerly used to rotate the separator disks 60 of prior U.S. Pat. No. 5,241,805 and as illustrated in FIG. 1 of the subject application.

More particularly and referring to FIG. 2 and 3 once again, the same frame 64 which supports the discs of FIG. 1 on a laterally extending cross shaft 67 in the prior Patent disclosure of FIG. 1 also supports the drive system of the present invention. Thus, the cross shaft 167 of the present invention is provided in a framework which can be elevated to a desired height in order to accommodate plastic bottles within a predetermined range of heights. The mechanism for accomplishing this adjustability is described in some detail in prior U.S. Pat. No. 5,241,805. Further, the means for rotating the shaft 167 like the means for rotating the shaft 67 of FIG. 1 is also described in some detail in that Patent. The shaft 167 is synchronized with operation of the case feed conveyor. FIG. 1 shows the case feed conveyor system in some detail and it is also described in prior U.S. Pat. No. 5,241,805.

In place of the rotating separator disks of FIG. 1, two sprockets 120, 120 are provided on the cross shaft 167 for rotation with the cross shaft and for driving parallel conveyor chains illustrated in part only and designated by the phantom line 130 of FIG. 2. Means is providing for tensioning each of these chains and as illustrated generally at 123 an idler sprocket is provided in tension against the outside of the chain 130 for this purpose.

Upstream and downstream chain track plates 130 and 140 respectively are mounted to the frame or superstructure 64 described previously by support plates 110, 110 illustrated to best advantage in FIG. 3. More particularly, the support plates 110, 110 are journaled on the cross shaft 167 by bearings 90,90 so that the plates 110 can be adjusted angularly to provide a desired tangential path for the chains as the chains move the flight bars 150 and lugs 200 into engagement with the plastic bottles approaching and entering the load station of the packer.

As the conveyor chains move the flight bars around the orbital path defined for them by the sprockets 120 and the plates 130 and 140, the flight bar lugs or pegs 200 are cammed into the desired orientation relative to the plastic bottles by cam tracks 201 mounted on the plates 130. More particularly, the cam tracks 201 positively orient the lugs 200 for controlled movement downwardly between the rows of bottles. The downstream plates 140 themselves serve by their external contour to determine the path taken by the lugs 200 leaving the load station.

The upstream cam tracks 201 are precisely positioned on the plates 130 in order to fine tune the path taken by the lugs 200 as they move from the position shown for the lug 200 at the upstream end of the plate 130 downwardly into the interstices or spaces provided between the bottles, as suggested by the lug 200 which is providing the gap between the adjacent rows of bottles as the bottles approach the downstream edge of the ramp 134 in FIG. 2.

Figure 4:
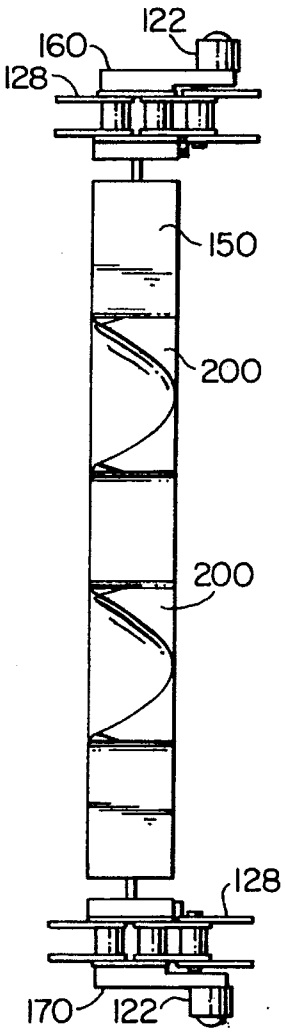
FIG. 4 is an end view of the flight bar and the lugs thereon of FIG. 3, being taken on the line 4—4 of FIG. 3.
Figure 2B:
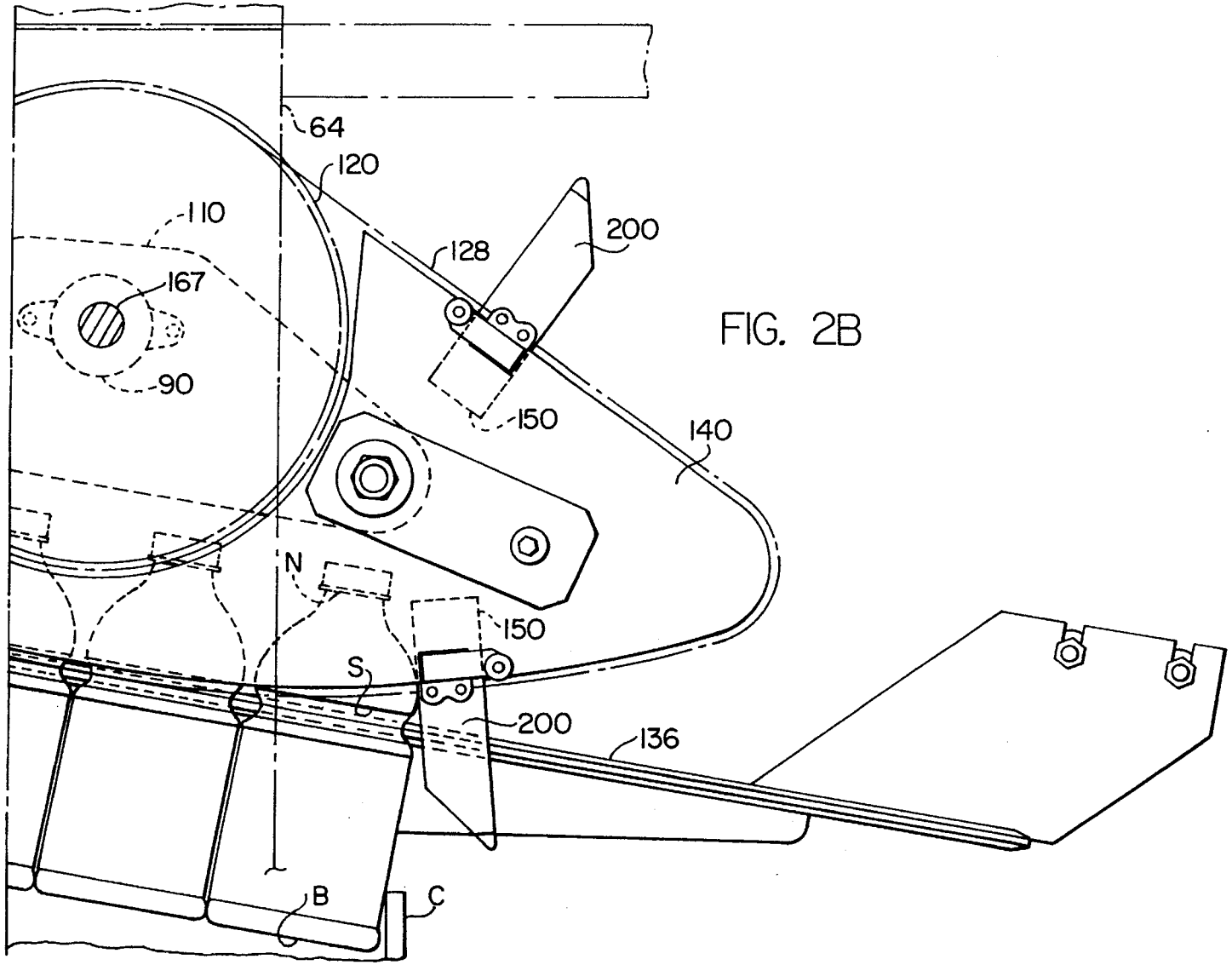

As best shown in FIG. 4, each flight bar 150 comprises a bar portion extending across and between the conveyors which drive it around the orbital path as described with reference to FIG. 2, and each flight bar further includes projecting cranks 160, 170 at its opposite ends that carry cam follower rollers 122,122 which cam rollers are adapted to be engaged by the fixed surfaces defined by the cam tracks 201 in order to assure the desired orientation of the lugs 200 with respect to the orbital path of movement of the flight bar.

As mentioned previously, the entire structure for supporting the conveyor chains that drive the bars 150 and consequently the lugs 200 is mounted pivotally on the shaft 167. Means must therefore be provided for anchoring the structure in the desired angular orientation, and preferably said means comprises vertically oriented angle brackets 250,250 which are secured to the upright super-structure 64 and which define vertically adjustable tracks or ways for slidably receiving the aforementioned plates 110, 110. Thus, the path of the flight bar conveyor chains can be adjusted vertically as well as adjusted angularly, to accommodate plastic bottles of various size and shape.

I claim:

1. In a plastic bottle packer wherein columns of bottles are continuously fed by line pressure between lane guides down an inclined path defining means such that groups of bottles are dropped off a downstream edge of said path into cases continuously fed below said path and in end-to-end relationship, and wherein a super-structure is provided for supporting a plurality of separator disks for rotation on an axis spaced above the path at a location where the cases enter a load station to receive the article groups, the improvement comprising:

a cross shaft defining said axis;

spaced sprockets carried by said cross shaft for rotation thereon;

flight chains driven by said sprockets;

chain track support plates mounted to said cross shaft;

chain tracks mounted to said support plates and defining at least portions of the paths taken by said flight chains, said path portions being oriented in a direction that converges with the path of the bottles approaching said load station; and flight bars carried by said chains, each flight bar defining lugs that move downwardly between the lane guides to create spaces between certain bottles in said columns whereby the bottles are grouped for dropping into the individual cases at the load station.

2. The combination according to claim 1 further characterized by cam following means adjacent at least one end of each flight bar, and a cam track provided on at least one chain track for orienting said flight bars in order that said lugs are positively held in a desired orientation with respect to said converging path direction of said flight chains.

3. The combination according to claim 1 further characterized by means for mounting said cross shaft in said superstructure so that said cross shaft can be adjustably positioned relative to said path of said bottles in order to accommodate bottles of various height and size.

4. The combination according to claim 1 further characterized by guide means being aligned with said inclined path for the bottles moving into said load station and defining said inclined path direction for the bottles entering said load station.

5. The combination according to claim 2 further characterized by means for mounting said cross shaft in said superstructure so that said cross shaft can be adjustably positioned relative to said path of said bottles in order to accommodate bottles of various height and size.

6. The combination according to claim 3 further characterized by guide means being aligned with said inclined path for the bottles moving into said load station and defining said inclined path direction for the bottles entering said load station.

7. The combination according to claim 1 further characterized by a second cross shaft for the separator disks, said second cross shaft being mounted in said superstructure in place of said first mentioned cross shaft, and said disks operable in place of said spaced sprocket flight bars, and chain tracks.

* * * * *